United States Patent [19]

Schmidt

[11] 4,409,944

[45] Oct. 18, 1983

[54] FUEL SUPPLY SYSTEM

[75] Inventor: Karl Schmidt, Dormagen-Gohr, Fed. Rep. of Germany

[73] Assignee: Pierburg GmbH & Co. KG, Neuss, Fed. Rep. of Germany

[21] Appl. No.: 290,208

[22] Filed: Aug. 5, 1981

[51] Int. Cl.[3] ..... F02M 7/00

[52] U.S. Cl. ..... 123/445; 261/50 A; 261/44 C

[58] Field of Search ..... 123/445; 261/50 A, 44 C

[56] References Cited

U.S. PATENT DOCUMENTS

| | | | |
|---|---|---|---|
| 3,198,498 | 8/1965 | Mennesson | 123/445 |
| 3,259,378 | 7/1966 | Mennesson | 261/50 A |
| 3,286,998 | 11/1966 | Mennesson | 261/50 A |
| 3,288,445 | 11/1966 | Mennesson | 261/50 A |
| 4,246,879 | 1/1981 | Fiala | 261/50 A |
| 4,290,399 | 9/1981 | Takada et al. | 261/44 C |
| 4,307,692 | 12/1981 | Fiala | 123/445 |

FOREIGN PATENT DOCUMENTS

| | | | |
|---|---|---|---|
| 2900459 | 7/1980 | Fed. Rep. of Germany | 123/445 |
| 2933705 | 3/1981 | Fed. Rep. of Germany | 261/44 C |
| 1409454 | 7/1964 | France . | |
| 854568 | 11/1960 | United Kingdom . | |
| 949666 | 2/1964 | United Kingdom . | |

*Primary Examiner*—Ira S. Lazarus
*Assistant Examiner*—Magdalen Moy
*Attorney, Agent, or Firm*—Toren, McGeady and Stanger

[57] ABSTRACT

A fuel supply system for a mixture-compressing combustion engine includes a main air channel containing a throttle valve with a suction pipe connected to the downstream end of the main air channel and extending to the inlet valves for the engine. An air quantity measuring valve is located in the main air channel upstream of the throttle valve. A carrier-air channel branches off from the main air channel between the air quantity measuring valve and the throttle valve. Spaced from the main air channel is a fuel metering nozzle which opens into the carrier-air channel. A proportioning valve is located in the fuel metering nozzle and is adjustable by the air quantity measuring valve. A differential pressure valve is connected to the carrier air channel and contains a membrane acted upon on one side by an adjustable force member and the air pressure in the carrier-air channel adjacent the fuel metering nozzle and on the other side by the air pressure in the carrier air channel upstream from the fuel metering nozzle. Accordingly, the fuel metering nozzle is independent of fluctuations in the power generating the flow of carrier air.

1 Claim, 1 Drawing Figure

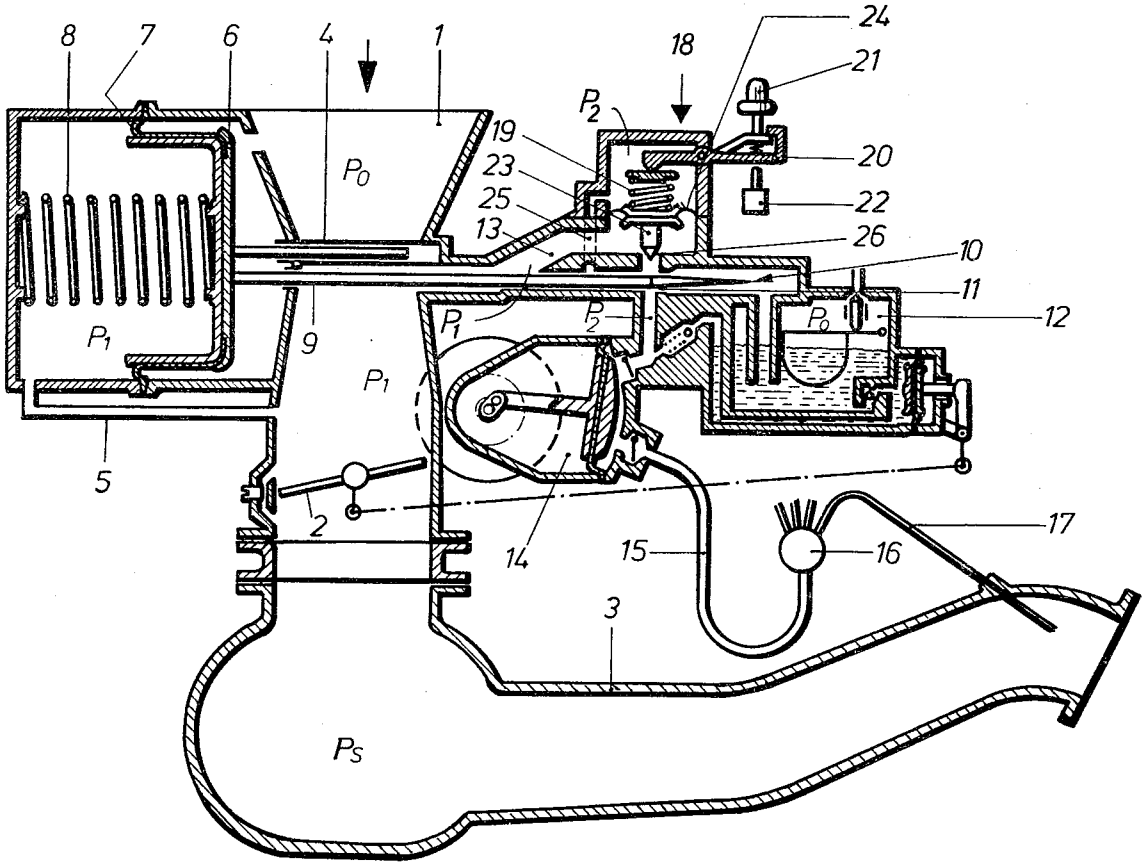
24
21
20
22
26
10
11
12
17
16
18
15
3
14
19
23
25
13
1
4
6
7
8
9
2
5
$P_0$
$P_1$
$P_2$
$P_S$

FUEL SUPPLY SYSTEM

The invention refers to a fuel supply system for mixture-compressing combustion engines, having in addition to a main air channel exhibiting a throttle valve, a carrier-air channel into which opens a fuel metering nozzle, having a pump associated with the fuel metering nozzle, having distributor channels leaving the carrier-air channel downstream of the pump, which lead to the associated intake stubs before the inlet valves, and having a control valve which is adjustable in dependence upon operating parameters of the engine, arranged before the fuel metering nozzle to control the flow of carrier air.

A system of that kind is known from the West German Pat. No. 1 243 917. Even in the case of a fuel supply system of that kind an adaptation is necessary of the composition of the mixture to the needs of the engine for cold starting and for the hot running phase.

Again from the British Pat. No. 854 568, a system comparable with the species is known in which a cross-section is exposed to a certain degree to correspond with a characteristic quantity of the engine, whereby a proportioning reduced pressure is set, which, however, depends in its magnitude upon the suction power which may be liable to alter over the life of the compressor or from compressor to compressor. The proportioning differential pressure is thereby a value which cannot be reproduced with certainty.

In the case of a fuel supply system of the kind mentioned initially, the problem underlying the invention is to create a system by which an adaptation of the composition of the mixture to the needs of the engine is possible, in particular for cold starting and for the hot running phase, and in which the proportioning differential pressure is reproducible and even in the case of mechanical faults in the fuel metering system, the delivery of the correct quantity of fuel to correspond with the operating point of the engine is taken care of.

In the case of a fuel supply system of the kind mentioned initially, this problem is solved in the way that in a manner in itself known there is provided on the fuel metering nozzle a proportioning valve which is adjustable in dependence upon an air quantity measuring valve arranged in the main air channel upstream of the throttle valve, that the carrier-air channel branches off from the main air channel between the air quantity measuring valve and the throttle valve, and that the control valve in the carrier-air channel is a differential-pressure valve, the active area of which, is acted upon on one side by an adjustable force and the air pressure in the carrier-air channel at the fuel outlet point and on the other side by the air pressure in the carrier-air channel before the flow opening of the differential-pressure valve.

This control valve controls the free cross-section of the carrier-air channel and thereby the magnitude of the differential pressure of the air at the fuel nozzle, which brings about the fuel metering. This differential pressure is the drop in pressure between the air pressure in the float chamber and the pressure of the air downstream of the control valve in the carrier-air channel. Through variation of this differential pressure of the air, it is possible in a simple and advantageous way to determine the amount of fuel which is to be removed from the fuel nozzle and thereby the composition of the mixture. For the hot running phase it is adequate to provide merely a control valve, the active area of which gets acted upon in addition by the action of force from an electrically heated element of an expandable substance, so that with increasing heating the air channel gets exposed further and further. A further action upon this active area in dependence upon other operating parameters of the engine is readily possible through the action of force from an appropriately arranged magnet or a plunger coil system. What presents itself as an operating parameter of the engine is, e.g. the exhaust gas composition which as usual may be measured via an oxygen probe. In the processing of the operating parameters of the engine a microprocessor may be used, which then energizes the electrical correcting element of, e.g., a stepping motor. Regulation is also possible in the case of intermittent operating conditions such as in the acceleration phase.

An embodiment is illustrated diagrammatically in the drawing and explained in greater detail below.

The combustion of air sucked in by the engine flows in the direction of the arrow through a main air channel 1 past a throttle valve 2 and through an induction or suction pipe 3. Upstream of the throttle valve 2 there is arranged an air quantity measuring valve 4 made as a cross-slide.

The pressure P1 prevailing downstream of the air quantity measuring valve 4 is brought via a pipe 5 behind a piston 6 and a rolling membrane 7 and pulls the cross-slide open against the force of a spring 8 until the spring force is in equlibrium with the differential pressure P0–P1 multiplied by the effective membrane area. The stroke of the cross-slide is thereby a measure of the amount of air flowing through. A needle 9 is attached to the piston 6 and forms by its ground contour 10 in the nozzle 11 a proportioning cross-section, the magnitude of which is capable of being altered in dependence upon the position of the needle. The pressure difference P2–P0 sucks the fuel out of the float chamber 12 via the proportioning cross-section. The fuel together with a flow of carrier-air is sucked through the carrier-air channel 13 by a compressor 14 and fed by the latter through a pipe 15 to a distributor 16 and conveyed thence via injection pipes 17 into the section of the induction directly before the inlet valves.

In the case where there are no throttling points in the carrier-air channel 13, the pressure P2 is equal to the pressure P1 downstream of the air quantity measuring valve 4. If through, e.g., jamming of the cross-slide further opening of the proportioning cross-section 10/11 is prevented, the pressure P1 and the pressure P2 drop, the pressure difference P0–P2 rises and in spite of the proportioning cross-section 10/11 being too small, the correct amount of fuel is delivered.

The control valve 18 arranged in the carrier-air channel 13 is made as a differential pressure valve.

A lever 20 influences the prestress of the spring 19 and is influenced by, e.g., an element 21 of an expandable substance which is electrically heated. Through an electromagnet 22 or a plunger coil arrangement or a stepping motor, the spring force may be altered temporarily for the cold starting or for enrichment for accleration. Through the arrangement of a membrane 24 which carries the valve member 23 and which on the one side is acted upon by the variable force of the spring 19 and via the channel 25 by the air pressure in the carrier-air channel 13 at the fuel outlet point 11 and on the other side by the air pressure in the carrier-air channel before the flow opening 26 of the differential pressure valve 18, the fuel metering becomes independent of fluctuations in the power of the generator of the flow of carrier air, since the pressure difference between P1 and P2 is determined merely by the force of the spring 19. The pressure P2 in the carrier-air channel 13 is in normal service—without taking into consideration the action of the spring 19—equal to the pressure P1 downstream of the slide 4. If the latter, e.g., jams with increasing throughput, the proportioning cross-section does not change in the nozzle 11 since the needle 9 does not move. The pressures P1 and P2 drop and the pressure difference P0–P2 rises and in spite of the proportioning cross-section being too small, the correct amount of fuel is delivered. If the prestress of the spring 19 gets altered because of characteristic quantities of the engine, the pressure P2 under the action of the compressor 14 sucking at approximately constant r.p.m. is reduced and the pressure difference P0–P2 rises and more fuel gets delivered from the flow chamber 12 in which likewise atmospheric P0 prevails.

The action of force on the membrane 24 besides being altered by the aforesaid devices may also be altered by an altitude corrector. Again the alteration of the action of force is possible through the electrical correcting element by the employment of electronic equipment which processes a different operating parameter of the engine, in which case it is advantageous that through the differential pressure valve 18 the valve member 23 may lie in any position you like and through alteration of the action of the force in the sense of a reduction or an enlargement of the flow opening 26, enrichment or weakening of the composition of the mixture is effected.

I claim:

1. A fuel supply system for mixture-compressing combustion engines, having in addition to a main air channel including a throttle valve, a suction pipe connected to and extending downstream from said main air channel with the downstream end thereof arranged for connection to the inlet valves of the engine, a carrier-air channel connected to said main air channel upstream from said throttle valve and branching off from said main air channel, a fuel metering nozzle opening into said carrier-air channel, a pump associated with the fuel metering nozzle, distributor channels extending from the carrier-air channel downstream of the pump to the downstream end of said suction pipe, and a control valve adjustable in dependence upon operating parameters of the engine and arranged before the fuel metering nozzle to control the carrier-air, characterized in that a proportioning valve is provided in the fuel metering nozzle (11) and the proportioning valve is adjustable in dependence upon an air quantity measuring valve (4) arranged in the main air channel upstream of the throttle valve (2), the carrier-air channel (13) branches off from the main air channel (1) between the air quantity measuring valve (4) and the throttle valve (2), and the control valve in the carrier-air channel (13) is a differential-pressure valve (18) having a flow opening (26) communicating with the fuel metering nozzle (11) and containing a membrane (24) dividing the interior of the differential-pressure valve with the side of the membrane away from the flow opening acted upon by an adjustable force means (19) and the air pressure in the carrier-air channel (13) at the fuel metering nozzle (11) and the other side acted upon by the air pressure in the carrier-air channel upstream from the flow opening (26) of the differential-pressure valve (18).

* * * * *